US006248002B1

(12) United States Patent
Wang et al.

(10) Patent No.: US 6,248,002 B1
(45) Date of Patent: Jun. 19, 2001

(54) OBTAINING THE BETTER DEFECT PERFORMANCE OF THE FUSE CMP PROCESS BY ADDING SLURRY POLISH ON MORE SOFT PAD AFTER SLURRY POLISH

(75) Inventors: Hui-Ling Wang; Tong-Hua Kuan, both of Hsin-Chu; Ying-Lang Wang, Taichung; Yu-Ku Lin, Hsin-Chu, all of (TW)

(73) Assignee: Taiwan Semiconductor Manufacturing Company, Hsin-Chu (TW)

( * ) Notice: Subject to any disclaimer, the term of this patent is extended or adjusted under 35 U.S.C. 154(b) by 0 days.

(21) Appl. No.: 09/421,509

(22) Filed: Oct. 20, 1999

(51) Int. Cl.[7] ..... B24B 1/00
(52) U.S. Cl. ..... 451/41; 451/28
(58) Field of Search ..... 451/41, 63, 287, 451/288, 285; 437/228; 438/692, 691, 693, 745, 747, 748, 754, 756; 216/38, 88, 89

(56) References Cited

U.S. PATENT DOCUMENTS

| | | | | |
|---|---|---|---|---|
| 5,139,571 | | 8/1992 | Deal et al. | 106/3 |
| 5,166,093 | * | 11/1992 | Grief | 437/977 |
| 5,514,245 | * | 5/1996 | Doan et al. | 156/636.1 |
| 5,665,202 | | 9/1997 | Subramanian et al. | 438/692 |
| 5,702,563 | | 12/1997 | Salugsugan et al. | 156/636.1 |
| 5,731,245 | | 3/1998 | Joshi et al. | 438/705 |
| 5,735,731 | | 4/1998 | Lee | 451/143 |
| 6,153,526 | * | 11/2000 | Shih et al. | 438/692 |

* cited by examiner

*Primary Examiner*—Derris H. Banks
(74) *Attorney, Agent, or Firm*—George O. Saile; Stephen B. Ackerman

(57) ABSTRACT

A method to prevent the accumulation of particle impurities on the surface of a semiconductor substrate that contains wolfram plugs during the process of polishing the surface of the wafer. The polishing sequence consists of three distinct polishing steps whereby the first two steps use hard polishing pads while the third step uses a soft polishing pad with the application of slurry during the third polish.

33 Claims, 3 Drawing Sheets

OBTAINING THE BETTER DEFECT PERFORMANCE OF THE FUSE CMP PROCESS BY ADDING SLURRY POLISH ON MORE SOFT PAD AFTER SLURRY POLISH

BACKGROUND OF THE INVENTION (1) Field of the Invention

The invention relates to the fabrication of semiconductor devices, and more specifically to a method of removing accumulated slurry during the polishing of a semiconductor surface that contains W plug.

(2) Description of the Prior Art

During the fabrication of VLSI and ULSI semiconductor wafers, it is critically important to use wafers that are free of any surface particles or impurities since the presence of these impurities has a direct and negative effect on device yield and throughput. It is therefore of extreme importance to use effective means for the control and removal of these impurities from the surface of the wafer since these impurities may, during further high temperature processing steps, diffuse into the wafer surface thereby substantially altering the chemical composition of the wafer. In addition, impurities can be classified as donor or acceptor dopants, these dopants will have an impact on the performance of subsequently produced semiconductor devices. Yet other impurities may cause surface dislocations or internal stacking misalignments or faults further having a negative impact on semiconductor manufacturing yield and cost. It is therefore clear that an effective method must be available to thoroughly clean the surface of the semiconductor substrate from all impurities while this process of removal may have to be repeated at various intervals during the complete processing sequence.

The first processing step during wafer processing typically is a step of cleaning the wafer surface in order to remove all loose impurities. These impurities may have been introduced by atmospheric contaminants or semiconductor or chemical particles or residue left over and contained within the processing equipment from prior usage of this equipment.

After this first step of cleaning is completed, the wafer surface typically is treated with organic compounds to remove organic impurities such as greases or hydrocarbons. Typical organic compounds used for this step are acetone, trichloroethylene, methanol and ethanol.

As a final step in the cleaning process inorganic chemicals are used. These inorganic chemical mixtures are strong oxidants that form a thin oxide layer on the surface of the semiconductor wafer. As part of this process, this oxide layer is removed thereby removing the impurities that have been absorbed into the oxide layer.

The Chemical Mechanical Polishing process uses commercially available cleaning systems. These cleaning systems use a combination of rotating pads each pad being in direct physical contact with the wafer surface and, due to the rotating movement of the polishing pad with respect to the wafer surface, planarizes by means of an abrasive action, the top surface of the semiconductor wafer. The turntables used for this purpose typically rotate at various controlled speeds, for instance 10 to 100 RPM, in a controlled clockwise or counterclockwise direction. The wafer is clamped and held, typically face downward, against the rotating polishing pad. The size of the diameter of the polishing pads is typically considerably larger than the size of the diameter of the semiconductor substrate. This means that more than one polishing pad can be arranged to simultaneously polish the surface of the wafer, these polishing pads typically being arranged in circular patterns around the center of the wafer that is being polished.

Polishing pads are typically fabricated from a polyurethane and/or polyester base material and are commercially available such as models IC1000 or Scuba IV of a woven polyurethane material.

Chemical Mechanical Polishing (CMP) is a method of polishing materials, such as semiconductor substrates, to a high degree of planarity and uniformity. The process is used to planarize semiconductor slices prior to the fabrication of semiconductor circuitry thereon, and is also used to remove high elevation features created during the fabrication of the microelectronic circuitry on the substrate. One typical chemical mechanical polishing process uses a large polishing pad that is located on a rotating platen against which a substrate is positioned for polishing, and a positioning member which positions and biases the substrate on the rotating polishing pad. Chemical slurry, which may also include abrasive materials therein, is maintained on the polishing pad to modify the polishing characteristics of the polishing pad in order to enhance the polishing of the substrate.

One factor, which contributes to the unpredictability and non-uniformity of the polishing rate of the CMP process, is the non-homogeneous replenishment of slurry at the surface of the substrate and the polishing pad. The slurry is primarily used to enhance the rate at which selected materials are removed from the substrate surface. As a fixed volume of slurry in contact with the substrate reacts with the selected materials on the surface of the substrate, this fixed volume of slurry becomes less reactive and the polishing enhancing characteristics of that fixed volume of slurry is significantly reduced. One approach to overcoming this problem is to continuously provide fresh slurry onto the polishing pad.

In the CMP process, semiconductor substrates are rotated, face down, against a polishing pad in the presence of abrasive slurry. Most commonly, the layer to be planarized is an electrical insulating layer overlaying active circuit devices. As the substrate is rotated against the polishing pad, the abrasive force grinds away the surface of the insulating layer. Additionally, chemical compounds within the slurry undergo a chemical reaction with the components of the insulating layer to enhance the rate of removal. By carefully selecting the chemical components of the slurry, the polishing process can be made more selective to one type of material than to another. For example, in the presence of potassium hydroxide, silicon dioxide is removed at a faster rate than silicon nitride. The ability to control the selectivity of a CMP process has led to increased use in the fabrication of complex integrated circuits.

Specifically, applying the CMP process to Intra Level Dielectric (ILD) and Inter Metal Dielectric (IMD) that are used for the manufacturing of semiconductor wafers, surface imperfections (micro-scratch) typically present a problem. Imperfections caused by micro-scratches in the ILD and IMD can range from 100 to 1000 EA for 200 mm. wafers, where an imperfection typically has a depth from 500 to 900 $A^0$ and a width of from 1000 to 3000 $A^0$. As part of the polishing process of the ILD and IMD, a tungsten film is deposited; the surface imperfections will be filled with tungsten during this deposition. For devices within the semiconductor wafer with a dimension of 0.35 um. or larger, an etching process is used where the tungsten that has entered the imperfections within the wafer surface can be removed. For the larger size devices within the semiconductor wafer there is therefore no negative impact on the yield of these devices. For device sizes within the semiconductor wafer of 0.25 um or less, the indicated procedure of etching the tungsten layer is no longer effective. This results in relative large imperfections within the surface of the wafer, large with respect to the size of the semiconductor devices. These imperfections will cause shorts between the metal lines within the devices while the imperfections also have a severe negative impact on device yield and device reliability.

As part of the CMP process, oxide slurry can also be used. A typical CMP process uses only one polishing pad, this pad being a hard polishing pad, for instance an IC 1000 pad. In polishing a semiconductor surface wherein wolfram plugs have been created as part of the damascene process, it is found that the plug protrudes from the semiconductor surface be about 1000 Angstrom. This protrusion will have an impact on the polishing process since the plug protrusion interrupts the constant and uniform contact between the polishing pad and the surface of the semiconductor wafer. From this it is readily apparent that oxide slurry will not be uniformly removed from the immediate vicinity of the wolfram plug and that a body of oxide slurry will accumulate near the plug. A particle count of in excess of 5000 EA has been observed in such an environment. It is the objective of the present invention to reduce this particle count in the immediate vicinity of the wolfram plug.

FIGS. 1 through 5 show the results obtained in Prior Art polishing of a semiconductor surface that contains wolfram plugs. FIG. 1 shows wolfram plugs 12 and 14 that have been created in a semiconductor substrate 10. The surface of layer 16 is polished, the results of this polishing process are shown in FIG. 2. Plugs 20 and 22 (FIG. 2) show the formation of keyholes 18, these keyholes result in problems of W CMP dishing. To remedy these problems of W CMP dishing, the top of the wolfram plugs 20 and 22 is removed. This is done by first depositing oxide film 30, FIG. 3, over the surface of the substrate 10. This oxide film, also called Fuse film, is typically between 1000 and 2000 K-Angstrom thick. After this, using oxide slurry to polish the fuse film, a total of between about 2K and 4K Angstrom is removed. FIG. 4 shows how the tops of plugs 20 and 22 protrude through the surface of substrate 10. FIG. 4 shows the results of the ideal case of the Fuse film removal, that is the case where no extraneous or loose oxide particles remain after the removal of the Fuse film. FIG. 5 shows the results of an actual case of Fuse film removal, it demonstrates that oxide slurry remains and has accumulated on top of the wolfram plugs, accumulations 24 and 26, and in the immediate vicinity of the wolfram plug, accumulation 28. For the Prior Art case as shown in FIG. 5, an oxide film of about 1K Angstrom thickness will form on the surface of the wolfram plugs, this in addition to the indicated accumulation of the oxide slurries of 24, 26 and 28. In the case that is illustrated by FIG. 5, a defect count in the area of the wolfram plugs in excess of 5000 EA is consistently observed.

The overall Prior Art specifications for this three step polishing procedure are as follows:

| Step | #1 | #2 | #3 |
|---|---|---|---|
| Platen | Platen 1 | Platen 2 | Platen 3 |
| Pad | IC1000 | IC1000 | polytex |

-continued

| Step | #1 | #2 | #3 |
|---|---|---|---|
| Process | Slurry polish | Slurry polish | DI $H_2O$ rinse only |
| Removed | 1500 Angstrom | 1500 angstrom | none |

The dimensions of the amount of material removed during each of the three steps are approximate numbers provided to give an indication of the results of the polishing process.

The invention teaches an improved method of polishing of semiconductor surfaces wherein wolfram plugs are present.

U.S. Pat. No. 5,665,202 (Subramanian et al.) shows CMP method that uses a two different pad pressures.

U.S. Pat. No. 5,702,563 (Salugsugan et al.) teaches a method of reducing CMP contamination by using a water spray.

U.S. Pat. No. 5,735,731 (Lee) recites a CMP pad having soft and hard regions.

U.S. Pat. No. 5,731,254 (Joshi et al.) teaches a W-plug CMP process using a hard cap.

U.S. Pat. No. 5,139,571 (Deal et al.) shows a CMP slurry that reduces contamination.

SUMMARY OF THE INVENTION

A principle objective of the present invention is to reduce the defect count for polishing of semiconductor wafer surfaces that contain wolfram plugs using the CMP process.

Another objective of the present invention is to improve semiconductor wafer throughput during wafer polishing using the CMP process for semiconductor wafer surfaces that contain wolfram plugs.

Another objective of the present invention is to reduce shorts between metal lines within the devices contained within a semiconductor wafer that contains wolfram plugs.

Another objective of the present invention is to improve reliability of the devices contained within a semiconductor wafer that contains wolfram plugs.

Yet another objective of the present invention is to reduce oxide film on the surface of wolfram plugs in a semiconductor wafer.

Yet another objective of the present invention is to enhance the use and applicability of oxide slurry deposition as part of the process of semiconductor wafer CMP.

Yet another objective of the present invention is to enable reduction of semiconductor device dimensions for semiconductor devices that are created using semiconductor surfaces that contain wolfram plugs.

Yet another objective of the present invention is to enable reduction of semiconductor device dimensions to the quarter-micro range for semiconductor devices that are created using semiconductor surfaces that contain wolfram plugs.

Yet another objective of the present invention is to enhance the removal of oxide damascene residue during semiconductor wafer polishing.

In accordance with the objectives of the invention, the invention teaches a new polishing sequence when polishing the surface of a semiconductor substrate that contains wolfram plugs. A hard pad is used during the first phase of the polishing process; this hard pad is used to remove the majority of the oxide slurry. This first step of polishing is followed by a second step; the second step also uses a hard pad to remove the remainder of the deposited oxide slurry. The third and final step in the polishing sequence uses a soft pad but, as opposed to Prior Art where a DI water rinse with no polishing action was applied during the third polishing step, the invention teaches using a slurry polish for the third polishing step. The polishing sequence of the invention results in a reduction of the impurity count in the immediate vicinity of the wolfram plugs from over 5000 EA to less than 200 EA.

DESCRIPTION OF THE PREFERRED EMBODIMENT

Figure 6:
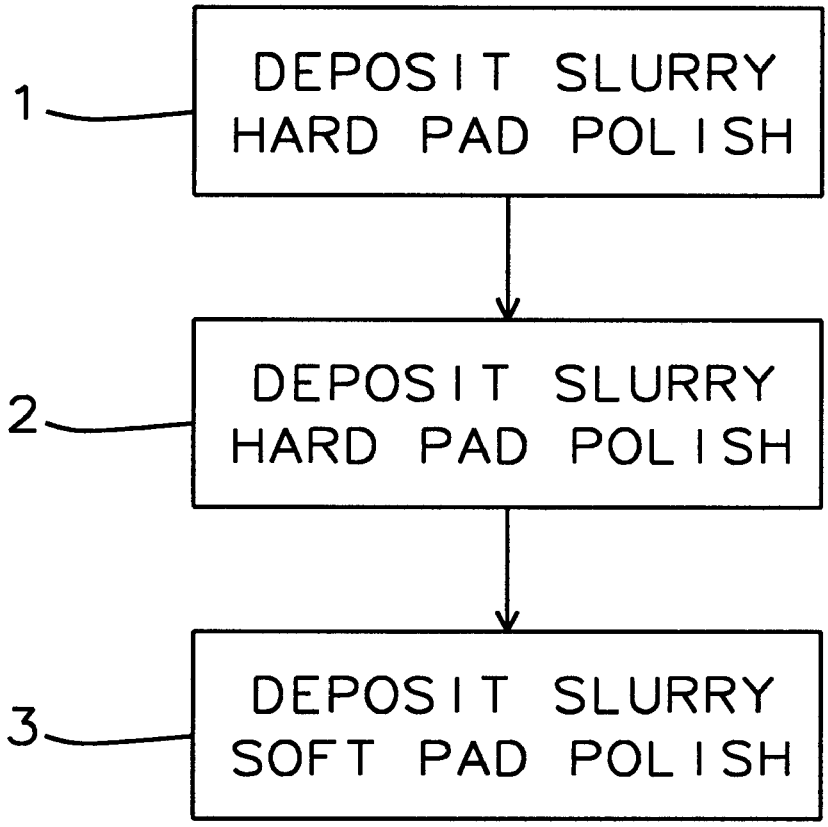
FIG. 6 shows the three step polishing procedure for the invention.

Referring now specifically to FIG. 6, there is shown the three polishing procedures of the invention.

FIG. 6 step 1 0indicates the first polishing process of the invention. During this polishing action, slurry is deposited on the surface of the semiconductor wafer; the polish is performed on the first platen of a three platen polishing arrangement. The polishing pad used fore this polish is a hard pad such as a commercially available IC1000 or its equivalent in chemical and/or mechanical abrasive polishing action. The slurry used for this polish contains oxide or an oxide derivative or any other typically applied slurry. This first polish typically removes about 1300 Angstrom from the surface of the semiconductor wafer.

FIG. 6 step 2 indicates the second polishing process of the invention. During this polishing action, slurry is again deposited on the surface of the semiconductor wafer; the polish is performed on the second platen of a three platen polishing arrangement. The polishing pad used fore this polish is again a hard pad such as a commercially available IC1000 or its equivalent in chemical and/or mechanical abrasive polishing action. The slurry used for this polish contains oxide or an oxide derivative or any other typically applied slurry. This second polish typically removes about 1300 Angstrom from the surface of the semiconductor wafer.

FIG. 6 step 3 indicates the third polishing process of the invention. During this polishing action, slurry is again deposited on the surface of the semiconductor wafer; the polish is performed on the third platen of a three platen polishing arrangement. The polishing pad used for this polish is a soft pad, typically a polytex pad or its equivalent in chemical and/or mechanical abrasive polishing action. The slurry used for this polish contains oxide or an oxide derivative or any other typically applied slurry. This third polish typically removes about 400 Angstrom from the surface of the semiconductor wafer.

The complete polishing procedure of the invention is a three step polishing procedure that is specified as follows:

| Step | #1 | #2 | #3 |
|---|---|---|---|
| Platen | Platen 1 | Platen 2 | Platen 3 |
| Pad | IC 1000 | IC 1000 | polytex |
| Process | Slurry polish | Slurry polish | Slurry polish |
| Removed | 1300 Angstrom | 1300 Angstrom | 400 Angstrom |

The dimensions of the amount of material removed during each of the three steps are approximate numbers provided to give an indication of the results of the polishing process.

Figure 1:
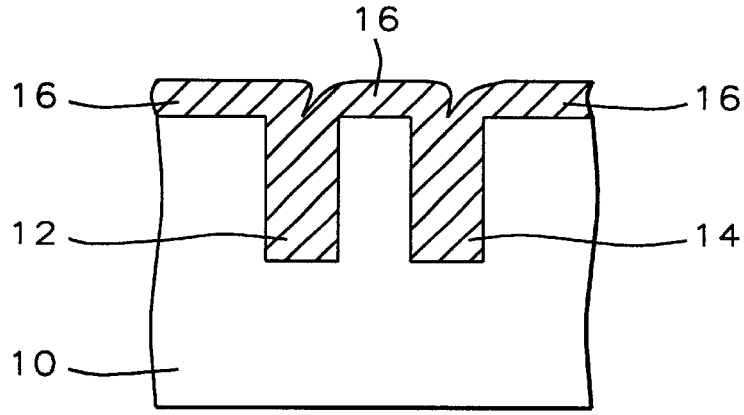
FIG. 1 shows a cross section of a semiconductor wafer wherein wolfram damascene plugs have been created.
Figure 2:
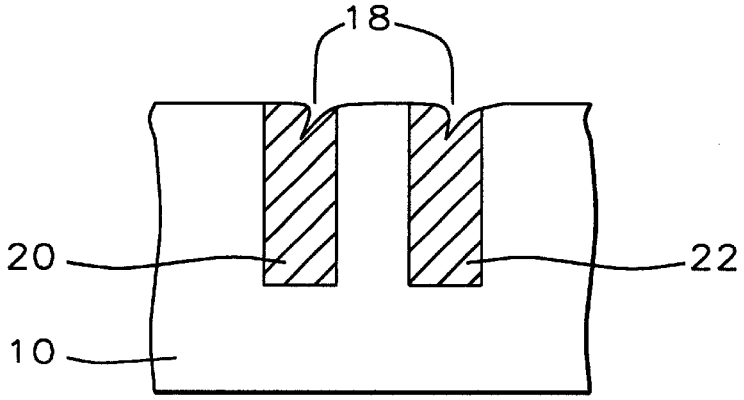
FIG. 2 shows the results of the Prior Art CMP of the surface of the semiconductor wafer.
Figure 3:
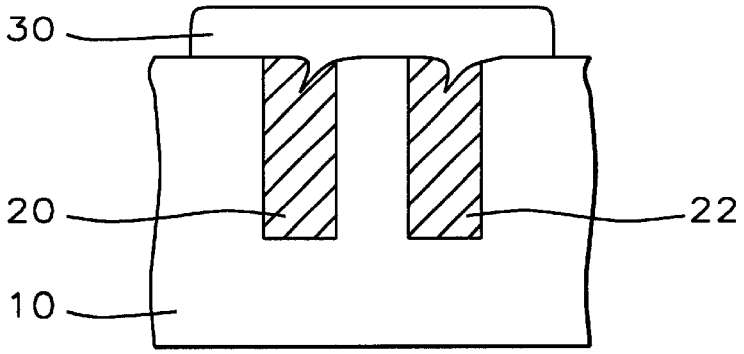
FIG. 3 shows the Prior Art deposition of a slurry film prior to CMP of the surface of the semiconductor wafer.
Figure 4:
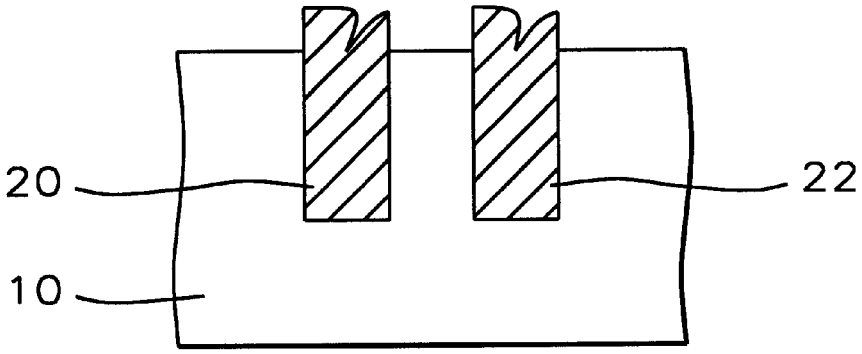
FIG. 4 shows the ideal results of CMP of the surface of the semiconductor wafer.
Figure 5:
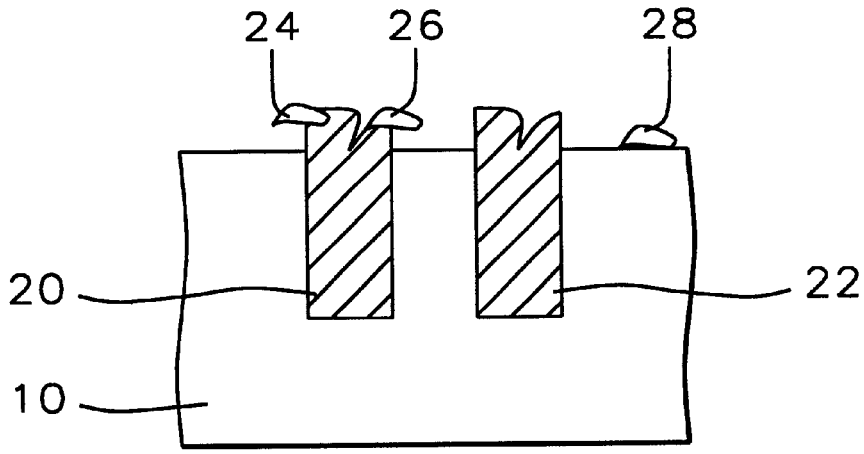
FIG. 5 shows the actual Prior Art results of the CMP of the surface of the semiconductor wafer.

The salient improvement under the invention is the modification of the third polishing step wherein, under the invention, the third polishing step uses oxide slurry applied with a soft pad. The polishing sequence of the invention results in a polished surface the cross section of which is shown in FIG. 4, it is clear from this that the oxide layer on the surface of the wolfram plugs has been removed as well as the accumulations of oxide slurry on the surface of the substrate in the immediate vicinity of the wolfram plugs.

While the present invention has been described in its preferred embodiment, it is understood that the descriptive text are words of description rather than words of limitation and that changes within the scope and meaning of the appended claims may be made without departing from the true scope and spirit of the invention in its broader scope.

What is claimed is:

1. A method for sequentially polishing a plurality of semiconductor wafers, said semiconductor wafers containing wolfram damascene plugs, which method comprises:

applying a first polishing procedure to a surface of said semiconductor substrate;

applying a second polishing procedure to a surface of said semiconductor substrate; and applying a third polishing procedure to a surface of said semiconductor substrate.

2. The method of claim 1 wherein said fist polishing procedure is:

applying a first pressurized spray of slurry to a surface of a polishing pad; and applying a first chemical mechanical polishing to a surface of said semiconductor to substantially remove silica from a surface of said semiconductor substrate thereby including a surface of said wolfram plug.

3. The method of claim 2 wherein said first CMP applies a polyurethane polishing pad or equivalent in pad chemically and physically abrasive action.

4. The method of claim 2 wherein said slurry of said first pressurized spray of slurry contains oxide.

5. The method of claim 2 wherein said slurry of said first pressurized spray of slurry contains silicon dioxide particles.

6. The method of claim 2 wherein said slurry of said first pressurized spray of slurry contains sodium hydroxide.

7. The method of claim 1 wherein said second polishing procedure is:

applying a second pressurized spray of slurry to a surface of a polishing pad; and applying a second chemical mechanical polishing to a surface of said semiconductor to substantially remove silica from a surface of said semiconductor substrate, thereby including a surface of said wolfram plug.

8. The method of claim 7 wherein said second CMP applies a polyurethane polishing pad or equivalent in pad chemically and physically abrasive action.

9. The method of claim 7 wherein said slurry of said second pressurized spray of slurry contains oxide.

10. The method of claim 7 wherein said slurry of said second pressurized spray of slurry contains silicon dioxide particles.

11. The method of claim 7 wherein said slurry of said second pressurized spray of slurry contains sodium hydroxide.

12. The method of claim 1 wherein said third polishing procedure is:

applying a third pressurized spray of slurry to a surface of a polishing pad; and applying a third chemical mechanical polishing to a surface of said semiconductor to complete removal of silica and slurry remnants from a surface of said semiconductor substrate thereby including a surface of said wolfram plug.

13. The method of claim 12 wherein said third CMP applies a polytex polishing pad.

14. The method of claim 12 wherein said slurry of said third pressurized spray of slurry contains oxide.

15. The method of claim 12 wherein said slurry of said third pressurized spray of slurry contains silicon dioxide particles.

16. The method of claim 12 wherein said slurry of said third pressurized spray of slurry contains sodium hydroxide.

17. A method for sequentially polishing a plurality of semiconductor wafers, said semiconductor wafers containing wolfram damascene plugs, which method comprises:

applying a first pressurized spray of slurry to a surface of a polishing pad;

applying a first chemical mechanical polishing to a surface of said semiconductor to substantially remove silica from a surface of said semiconductor substrate, thereby including a surface of said wolfram plug;

applying a second pressurized spray of slurry to a surface of a polishing pad;

applying a second chemical mechanical polishing to a surface of said semiconductor to substantially remove silica from a surface of said semiconductor substrate thereby including a surface of said wolfram plug;

applying a third pressurized spray of slurry to a surface of a polishing pad; and applying a third chemical mechanical polishing to a surface of said semiconductor to substantially remove silica from a surface of said semiconductor substrate, thereby including a surface of said wolfram plug.

18. The method of claim 17 wherein said first CMP applies a non fibrous woven polyurethane polishing pad.

19. The method of claim 17 wherein said second CMP applies a nonfibrous woven polyurethane polishing pad.

20. The method of claim 17 wherein said third CMP applies a polytex polishing pad.

21. The method of claim 17 wherein said first CMP applies a cellular polyurethane polishing pad.

22. The method of claim 17 wherein said second CMP applies a cellular polyurethane polishing pad.

23. The method of claim 17 wherein said first CMP applies a molded polyurethane polishing pad.

24. The method of claim 17 wherein said second CMP applies a molded polyurethane polishing pad.

25. The method of claim 17 wherein said slurry of said first pressurized spray of slurry contains oxide.

26. The method of claim 17 wherein said slurry of said second pressurized spray of slurry contains oxide.

27. The method of claim 17 wherein said slurry of said third pressurized spray of slurry contains oxide.

28. The method of claim 17 wherein said slurry of said first pressurized spray of slurry contains silicon dioxide particles.

29. The method of claim 17 wherein said slurry of said second pressurized spray of slurry contains silicon dioxide particles.

30. The method of claim 17 wherein said slurry of said third pressurized spray of slurry contains silicon dioxide particles.

31. The method of claim 17 wherein said slurry of said first pressurized spray of slurry contains sodium hydroxide.

32. The method of claim 17 wherein said slurry of said second pressurized spray of slurry contains sodium hydroxide.

33. The method of claim 17 wherein said slurry of said third pressurized spray of slurry contains sodium hydroxide.

* * * * *